US008567887B2

(12) United States Patent
Matsui et al.

(10) Patent No.: US 8,567,887 B2
(45) Date of Patent: Oct. 29, 2013

(54) INKJET RECORDING APPARATUS AND CONTROL METHOD OF THE INKJET RECORDING APPARATUS WHICH DETERMINES CURRENT VALUE CHANGES OF CURRENT FLOW THROUGH THE INK

(75) Inventors: Takahiro Matsui, Yokohama (JP); Takuya Hatsui, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 180 days.

(21) Appl. No.: 13/172,715

(22) Filed: Jun. 29, 2011

(65) Prior Publication Data

US 2012/0001971 A1 Jan. 5, 2012

(30) Foreign Application Priority Data

Jul. 2, 2010 (JP) ..... 2010-151945

(51) Int. Cl.
*B41J 29/38* (2006.01)

(52) U.S. Cl.
USPC ..... 347/9; 347/10

(58) Field of Classification Search
USPC ..... 347/20, 48, 55, 61–65, 67, 57–59, 14, 347/19, 22–23, 26, 28
See application file for complete search history.

(56) References Cited

U.S. PATENT DOCUMENTS 4,626,875 A * 12/1986 Hara et al. ..... 347/56
5,457,389 A * 10/1995 Shibata ..... 324/514
7,287,838 B2 * 10/2007 Tsuchii et al. ..... 347/63

FOREIGN PATENT DOCUMENTS

JP 2008-105364 A 5/2008

* cited by examiner

*Primary Examiner* — Juanita D Jackson
(74) *Attorney, Agent, or Firm* — Canon USA, Inc., I.P. Division

(57) ABSTRACT

An inkjet recording apparatus includes a heating unit configured to produce thermal energy for discharging ink, and two electrodes which electrically connect with each other through the ink. Voltage is applied between the two electrodes, and a current value flowing through the ink is measured. Whether the ink is discharged or not is determined by determining whether the current changes when the heating unit is driven.

7 Claims, 9 Drawing Sheets

INKJET RECORDING APPARATUS AND CONTROL METHOD OF THE INKJET RECORDING APPARATUS WHICH DETERMINES CURRENT VALUE CHANGES OF CURRENT FLOW THROUGH THE INK

BACKGROUND OF THE INVENTION

1. Field of the Invention

The present invention relates to an inkjet recording apparatus for performing recording on a recording medium by discharging ink and a control method of the inkjet recording apparatus.

2. Description of the Related Art

An inkjet recording method is a method for performing recording by discharging liquid (for example, ink) from discharge ports of an inkjet recording head so that the liquid adheres onto a recording medium such as paper. The inkjet recording method can perform high image quality and high-speed recording by using bubbles of the liquid caused by thermal energy produced in a heating unit and discharging the liquid.

Generally, the inkjet recording head includes a plurality of inkjet discharge ports, an ink flow path communicating with the ink discharge ports, and a heating unit producing thermal energy for discharging the ink. To the ink flow path, the ink is supplied from an ink tank, and the supplied ink is reserved in the vicinity of the ink discharge ports. In such a state, if the heating unit is driven and thermal energy is produced, the ink in the vicinity of the ink discharge ports is heated by the thermal energy and bubbles are formed. By pressure caused by the bubbling, the ink is discharged.

In such a mechanism, an ink contact portion (heat affected portion) of the heating unit that is heated by the heating unit is subjected to a multiple effect including cavitation impact due to bubbling or contraction of the ink and chemical functioning by the ink while being exposed to high temperatures when the ink is discharged. Generally, in order to reduce the cavitation impact or the influence of the chemical functioning due to the ink, a protective layer including a metallic material is provided to the heat affected portion. The temperature of the surface of the protective layer may increase to around 700° C., and the surface comes in contact with the ink. Accordingly, for the material used for the protective layer, it is required to have excellent heat resistance, mechanical characteristics, chemical stability, alkaline resistance, and the like.

At the same time, if color materials, added substances, and the like contained in the ink are decomposed by high temperature heating, the materials may change into low solubility materials (hereinafter, such materials are also referred to as a burnt deposit). If the materials adhere to the heat affected portion of the protective layer, the heat is not uniformly conducted from the heating unit to the ink, and results in unstable bubbling. Then, the ink may not be discharged. To solve this issue, in the inkjet recording apparatuses, the burnt deposit needs to be removed from the heat affected portion of the inkjet recording head at appropriate timing.

Japanese Patent Application Laid-Open No. 2008-105364 discusses an inkjet recording apparatus in which cleaning of an inkjet recording head is performed when the number of times of ink discharge exceeds a predetermined value in order to remove the burnt deposit.

However, an adhesion state of the burnt deposit onto the heating unit of the inkjet recording head varies depending on the type of the ink or the recording method. Accordingly, it is necessary to correctly determine whether the burnt deposit adheres to the heat affected portion.

SUMMARY OF THE INVENTION

According to an aspect of the present invention, an inkjet recording apparatus includes an inkjet recording head including a heating unit configured to produce thermal energy for discharging ink, and a pair of electrodes which are disposed facing a flow path of the ink and electrically connect with each other through the ink, a voltage applying unit configured to apply voltage between the pair of electrodes, a measurement unit configured to measure a current value flowing between the pair of electrodes, and a control unit configured to drive the heating unit in a state that the voltage is applied by the voltage applying unit, and determine whether the current value to be measured by the measurement unit changes.

According to another aspect of the present invention, a method for controlling an inkjet recording apparatus that includes an inkjet recording head including a heating unit configured to produce thermal energy for discharging ink, and a pair of electrodes which are disposed facing a flow path of the ink and electrically connect with each other through the ink includes measuring a current value flowing through the ink by applying voltage between the pair of electrodes, and determining whether the current value changes when the heating unit is driven.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
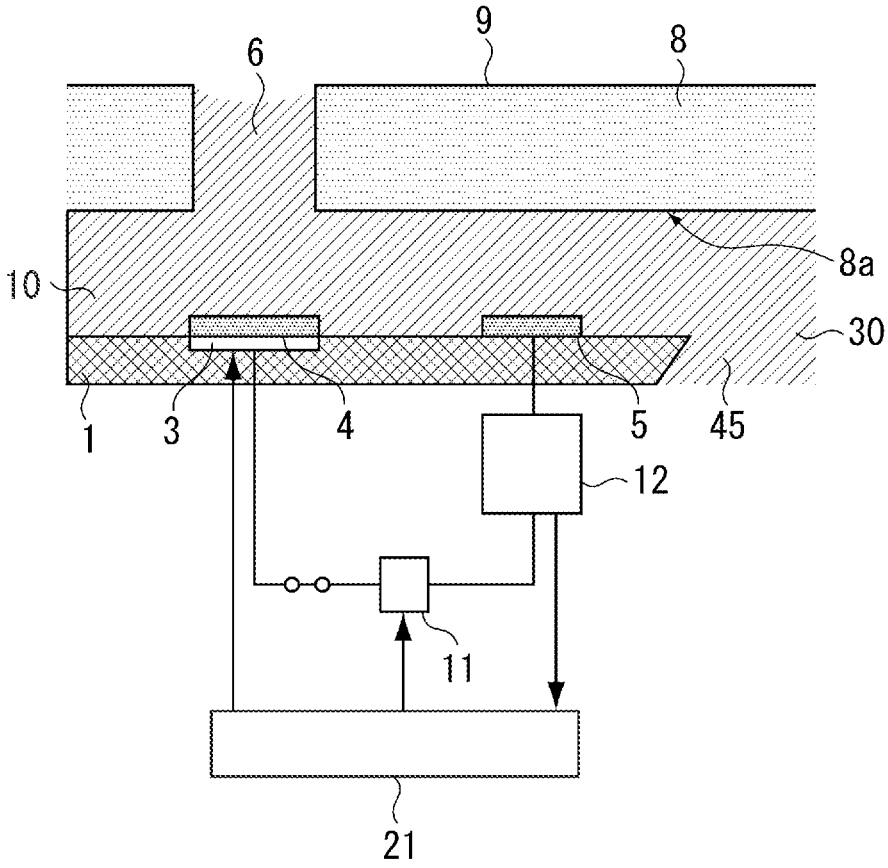
FIG. 1 is an example of a schematic view illustrating a configuration of an inkjet recording apparatus.

Various exemplary embodiments, features, and aspects of the invention will be described in detail below with reference to the drawings.

The term "record" used in the present specification means not only to form an image having meaning such as characters or graphics on a recording medium such as paper, but also to form an image having no meaning such as patterns.

In the description below, to components that have similar functions, the same reference numerals are applied in the drawings, and their descriptions may be omitted.

An inkjet recording apparatus according to an exemplary embodiment detects an ink discharge state by measuring a value of electric current flowing through electrolyte-containing ink reserved in an ink flow path, and determines whether to perform cleaning of the inkjet recording head based on the ink discharge state.

Figure 4:
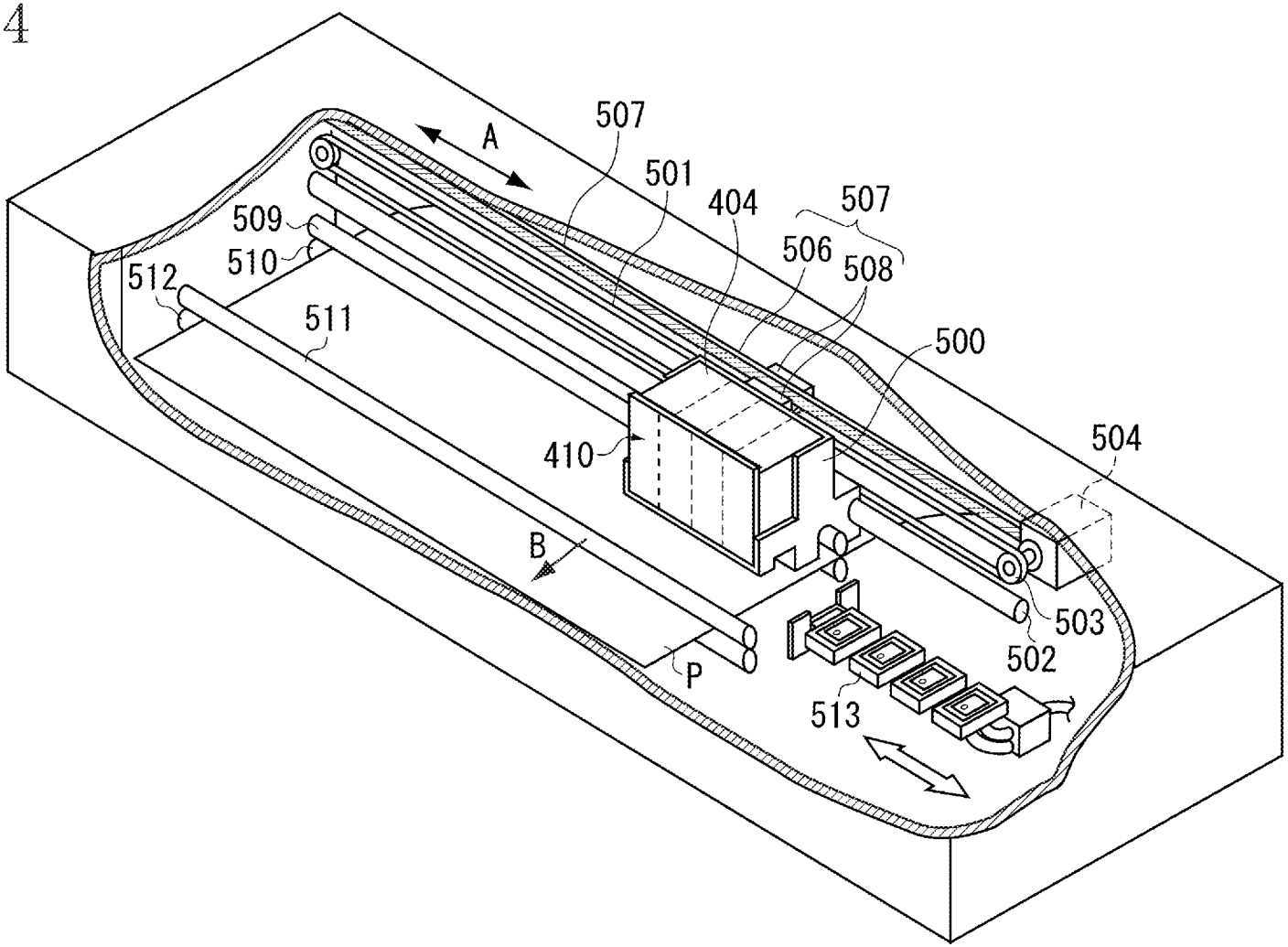
FIG. 4 illustrates an example of a mechanical configuration of an inkjet recording apparatus according to an exemplary embodiment of the present invention.

FIG. 4 illustrates a configuration of the inkjet recording apparatus that can mount an inkjet recording head according to an exemplary embodiment of the present invention. A carriage 500 is fixed to an endless belt 501, and can move along a guide shaft 502. The endless belt 501 is wound around pulleys 503. To one of the pulleys 503, a drive shaft of a carriage motor 504 is connected. The carriage 500 performs main scanning in reciprocating directions (direction A) along the guide shaft 502 in response to rotary drive of the carriage motor 504.

On the carriage 500, a cartridge type inkjet head unit 410 is mounted. In the inkjet head unit 410, inkjet discharge ports 6 of an inkjet recording head 9 (hereinafter, also referred to as a recording head) face to paper P that serves as a recording medium. The inkjet head unit 410 is mounted on the carriage 500 such that each array of the ink discharge ports corresponds to a direction (direction B) different from the main scanning direction (the direction A). The direction B is a sub-scanning direction which is, for example, a conveyance direction of the paper P. The number of pairs of the inkjet recording head 9 and an ink tank 404 can be the number corresponding to ink colors to be used. In FIG. 4, four pairs corresponding to four colors (for example, black, yellow, magenta, and cyan) are provided.

To the inkjet recording apparatus illustrated in FIG. 4, for the purpose of detecting a movement position of the carriage 500 in the main scanning direction, a linear encoder 507 is provided. One component of the linear encoder 507 is a linear scale 506 provided along the movement direction of the carriage 500. On the linear scale 506, slits are formed in equal intervals at predetermined density.

Further, as the other component of the linear encoder 507, a slit detection system 508 including, for example, alight emitting portion and a light receiving sensor and a signal processing circuit are provided to the carriage 500. Accordingly, from the linear encoder 507, a discharge timing signal for defining ink discharge timing and carriage position information are output in response to the movement of the carriage 500.

The recording paper P serving as the recording medium is intermittently conveyed in the arrow B direction orthogonal to the scanning direction of the carriage 500. The recording paper P is supported by a pair of roller units 509 and 510 of the upstream of the conveyance direction and a pair of roller units 511 and 512 of the downstream side. The recording paper P is added a constant tension and is conveyed in a state flatness to the inkjet recording head 9 is ensured. Driving force to each roller unit is transmitted from a conveyance motor (not shown).

With the above-described configuration, recording onto the entire of the paper P is performed by alternately repeating recording in the width corresponding to the width of the array of the ink discharge ports 6 of the inkjet recording head 9 and the conveyance of the paper P in response to the movement of the carriage 500.

The carriage 500 stops at a home position at start of the recording or as needed during the recording. At the home position, a cap member 513 that caps a face (discharge port face) where the ink discharge ports of each inkjet recording head are formed is provided.

To the cap member 513, a mechanism (not shown) for producing negative pressure in the cap to forcibly suck the ink from the ink discharge ports 6 and discharging the ink in the ink flow path is connected. The mechanism for sucking and discharging ink is generally referred to as a suction recovery mechanism, and an ink discharge operation performed by the mechanism is referred to as suction recovery operation. By the suction recovery operation, clogging of the ink discharge ports 6, and the like can be prevented.

Figure 8A:
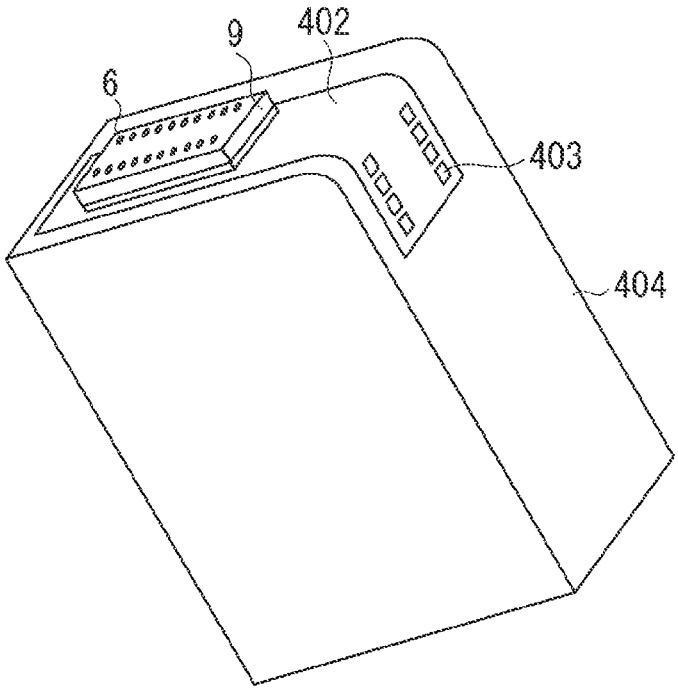
FIGS. 8A and 8B are examples of an inkjet head unit and an inkjet recording head that can be used in the exemplary embodiment of the present invention.

FIG. 8A illustrates the inkjet head unit 410 that includes the inkjet recording head 9. The inkjet recording head 9 is electrically connected to contacts 403 that provide connection with the inkjet recording apparatus by a flexible circuit board formed by tape automated bonding (TAB) for supplying electric power or the like. Here, the inkjet head unit 410 that includes the ink tank 404 for supplying the ink to an inkjet head 1 and the inkjet recording head 9 is described as an example, however, the inkjet head unit 410 can be formed as a separable-type unit in which the ink tank can be separately provided.

Figure 8B:
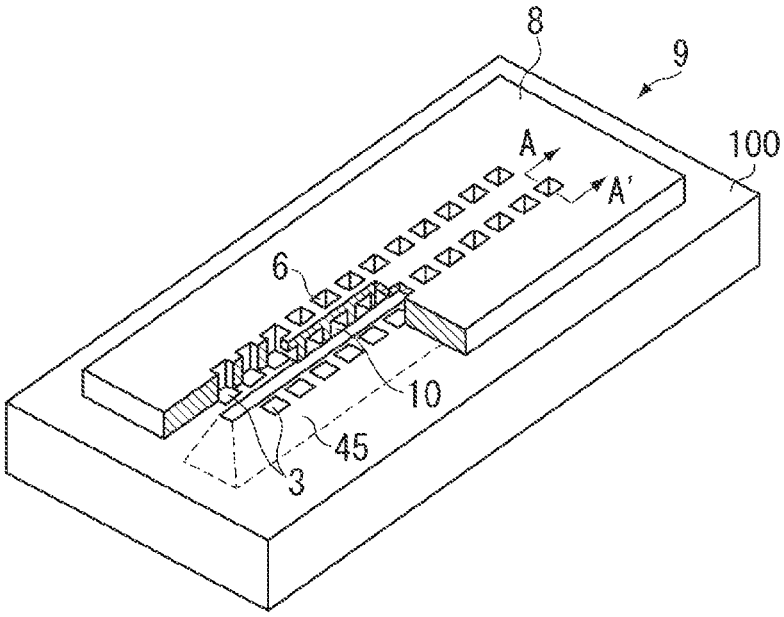

FIG. 8B is a perspective view of the inkjet recording head 9.

The inkjet recording head 9 includes an inkjet recording head substrate (hereinafter, also referred to as head substrate) 100 including heating units 3 for producing thermal energy to be used for discharging liquid, and a flow path wall member 8 provided on the inkjet recording head substrate 100. The flow path wall member 8 can be formed using a hardened material of a thermosetting resin such as an epoxy resin, and includes the ink discharge ports 6 for discharging the liquid, and a wall 8*a* of a flow path 10 that communicates with the ink discharge ports 6. The flow path 10 is formed such that the wall 8*a* is inside, and the flow path wall member 8 comes in contact with the head substrate 100.

The ink discharge ports 6 provided to the flow path wall member 8 are arrayed in predetermined pitches along a supply port 45. The liquid supplied from the supply port 45 is carried to the flow path 10, and further, the thermal energy produced by the heating units 3 causes film boiling of the liquid, so that bubbles are generated. The pressure generated by the film boiling causes discharge of the liquid from the ink discharge ports 6, then, recording operation is performed. The inkjet recording head 9 further includes a terminal (not show) for electrically connecting to an external device, for example, a liquid discharge device.

Figure 9:
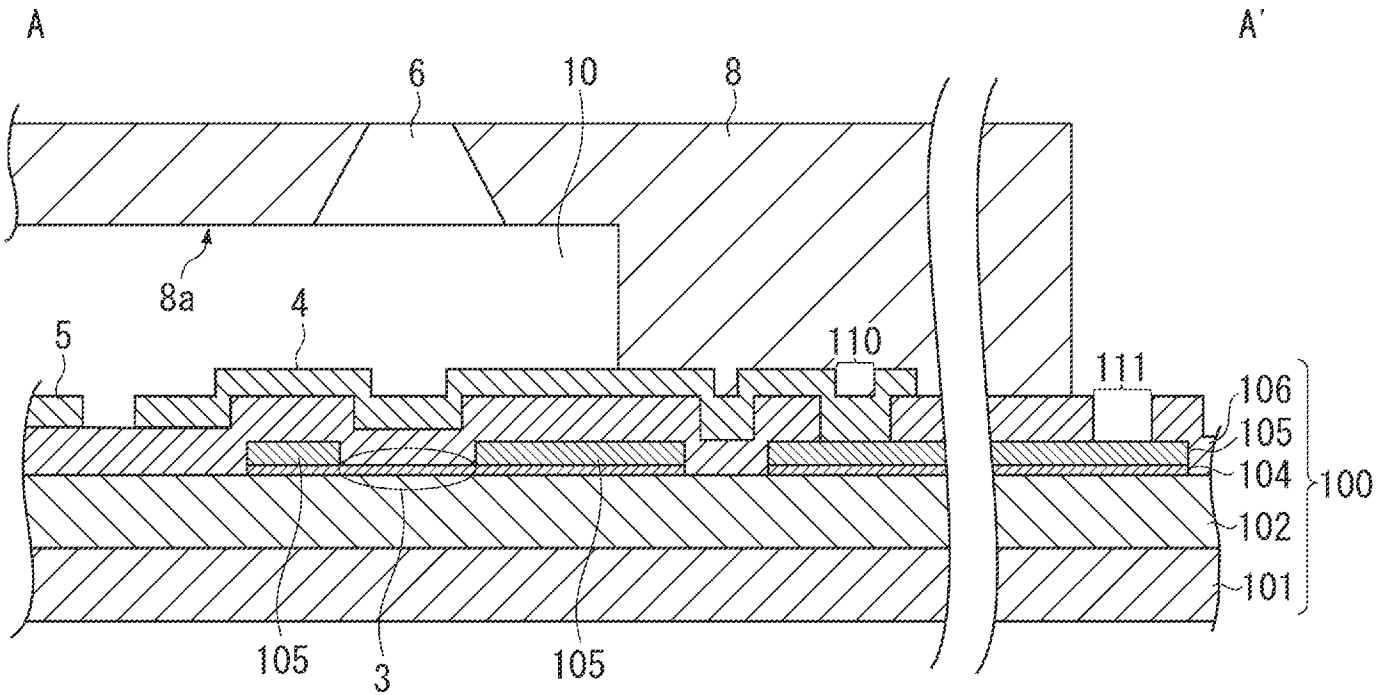
FIG. 9 is a cross-sectional view of the inkjet recording head that can be used in the exemplary embodiment of the present invention.

FIG. 9 schematically illustrates the state of the section taken along the line A-A' in FIG. 8B. On a base substance 101 containing silicon on which drive elements such as a transistor are provided, a heat accumulation layer 102 including a thermal oxide layer, a silicon monoxide (SiO) film, a silicon nitride (SiN) film, and the like is provided. On the heat accumulation layer 102, a heat resistance element layer 104 containing a material that produces heat by passage of an electric current (for example, TaSiN, WSiN, or the like) is provided. Further, a pair of lines 105 containing a material whose main component is aluminum having resistance lower than that of the heat resistance element layer is provided such that the lines 105 come in contact with the heat resistance element layer 104.

A part of the heat resistance element layer 104 can be used as the heating unit 3 by applying voltage between the pair of lines 105 to pass an electric current through the part of the heat resistance element layer 104 located between the pair of lines 105 to produce heat. ON/OFF of the electric current flowing between the pair of lines 105 is controlled by a switching element (not shown) such as a metal oxide semiconductor field-effect transistor (MOSFET) in response to a drive signal input from the recording apparatus. In other words, the drive timing of the heating unit 3 is determined in response to the drive signal.

The heat resistance element layer 104 and the pair of lines 105 are covered with an insulating layer 106 containing an insulating material, for example, a silicon compound such as SiN in order to insulate from the liquid used for discharging the ink, or the like. On the insulating layer 106 corresponding to the position of the heating unit 3, burnt deposits may adhere due to cavitation impact caused by bubbling and contraction of the liquid for discharge and a long-term discharge operation.

To solve this issue, a protective layer 4 having anti-cavitation properties, and containing a metallic material that can remove the burnt deposit is disposed in the area on the heating unit 3. More specifically, iridium or ruthenium can be used for the protective layer. On the inkjet recording head substrate 100, a counter electrode 5 that is electrically separated from the protective layer 4 is provided. In the present exemplary embodiment, the configuration provided using the same material as the protective layer 4 is described. However, other metallic materials can be used. Further, on the inkjet recording head substrate 100, the flow path wall member 8 is provided.

The protective layer 4 is electrically connected with a terminal portion 111 via a through hole 110, and formed so as to be electrically connected with the inkjet recording apparatus. Between the protective layer 4 and the insulating layer 106, an adhesion layer containing a conductive material can be provided in order to ensure adhesion. For example, if an adhesion layer of tantalum is provided, the adhesion between a layer containing silicon oxide and a layer containing iridium can be increased.

Figure 5:
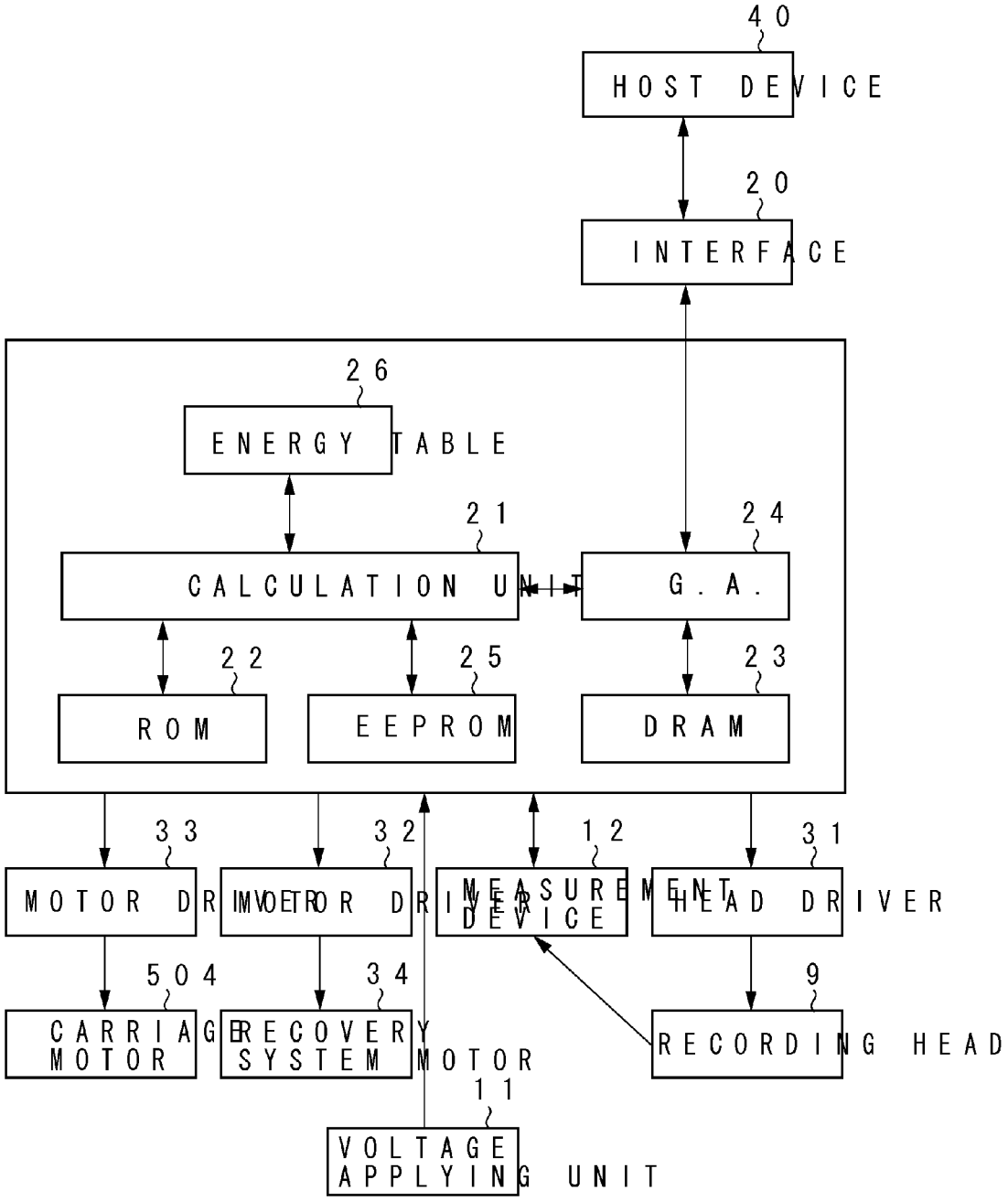
FIG. 5 is a block diagram illustrating an example of a configuration of a control system of the inkjet recording apparatus.

FIG. 5 is a block diagram illustrating an example of a configuration of the control system of the inkjet recording apparatus.

The inkjet recording apparatus includes an interface 20, a calculation unit 21, a read-only memory (ROM) 22, and a dynamic random access memory (DRAM) 23. Further, the inkjet recording apparatus includes a gate array (G.A.) 24, an electrically erasable and programmable read only memory (EEPROM) 25, and an energy table 26. Further, the inkjet recording apparatus includes a head driver 31, motor drivers 32 and 33, the inkjet recording head 9, a voltage applying unit (voltage applying means) 11, a measurement device (measurement means) 12, a recovery system motor 34, and a carriage motor 504.

The interface 20 receives a recording signal including a command or image data transmitted from a host device 40 such as a computer, a digital camera, a scanner, or the like. The interface 20 transmits status information of the inkjet recording apparatus to the host device 40 as needed.

The calculation unit 21 serves as a control unit for controlling each unit in the inkjet recording apparatus according to a control program corresponding to cleaning processing and discharge energy change processing and required data stored in the ROM 22.

The ROM 22 stores the control program corresponding to the cleaning processing and the discharge energy change processing and the required data. The data may include conditions for driving the inkjet recording head 9, such as pulse shapes and pulse widths (time) of the drive signal for controlling the drive of the heating unit 3 to discharge liquid, a voltage to be applied between the protective layer 4 and the counter electrode 5, and time of the voltage application. The data may also include data indicating conditions of recording medium conveyance, and data indicating a carriage speed.

The DRAM 23 is a memory for storing various types of data (a recording signal from the host device 40, recording data supplied to the inkjet recording head 9, and the like).

The gate array 24 supplies the recording data to the inkjet recording head 9 and controls data transfer among the interface 20, the calculation unit 21, and the DRAM 23.

The EEPROM 25 is a nonvolatile memory for storing the required data even if the electric power of the recording device is turned off.

For the calculation unit 21, a micro processing unit (MPU), or the like can be used. The calculation unit 21 controls drive timing of the heating unit 3 by outputting a drive signal, and produces discharge energy in the heating unit 3. The energy table 26 stores data for gradually changing magnitude of the discharge energy in the cleaning processing or the discharge energy change processing.

The carriage motor 504 is used as a drive source for operating the carriage. The recovery system motor 34 is used as a drive source for a capping operation by the cap member 513 and for the suction recovery operation by a pump (not shown), or the like. The motor drivers 32 and 33 are drive devices for driving the carriage motor 504 and the recovery system motor 34 respectively.

The head driver 31 is a drive device for driving the inkjet recording head 9. The voltage applying unit 11 is used for applying voltage between the protective layer and the counter electrode 5. The measurement device 12 measures an electric current flowing between the protective layer 4 and the counter electrode 5 through the ink.

(Determination of Discharge State)

FIG. 1 simply illustrates a connection state of the heating unit 3, the protective layer 4, and the counter electrode 5 of the inkjet recording head 9, and the calculation unit 21, the voltage applying unit 11, and the measurement device 12 of the inkjet recording apparatus.

The protective layer 4 and the counter electrode 5 are provided to the inkjet recording head 9 such that the protective layer 4 and the counter electrode 5 are electrically separated from each other, however, when the ink is reserved in the flow path 10, an electric current flows through the ink.

In the inkjet recording apparatus according to the present exemplary embodiment, the ink that contains an electrolyte and in which charge transfer between the electrodes decreases as time passes is used.

A reaction that occurs when a voltage for discharge detection (hereinafter, also referred to as a first voltage) is applied between the protective layer 4 and the counter electrode 5 using the voltage applying unit 11 in the inkjet recording head 9 in which such ink is filled is described. In the state, the protective layer 4 and the counter electrode 5 serve as a pair of electrodes.

If the application of the voltage is started in order to detect discharge, electric charge in the ink moves, and the flow of the electric current is measured by the measurement device 12. However, the electric current measured by the measurement device decreases as time passes, and soon, only a very small electric current flows between the protective layer 4 and the counter electrode 5. This is because the movement of the electric charge in the ink decreases. In such a state, if, for example, the ink is discharged from the ink discharge ports 6 and is newly supplied in the flow path 10, the movement of the electric charge in the ink occurs again. More specifically, in the state the voltage is applied from the voltage applying unit 11, the discharge state of the ink can be detected by measuring the current value flowing between the electrodes through the ink.

The change of the current value flowing through the ink by the electrochemical reaction of the protective layer 4 and the ink due to the ink discharge states is described in detail with reference to FIGS. 2A to 3D.

FIGS. 2A to 2D are schematic views illustrating the state change of the inkjet recording head 9 due to ink discharge.

Figure 3A:
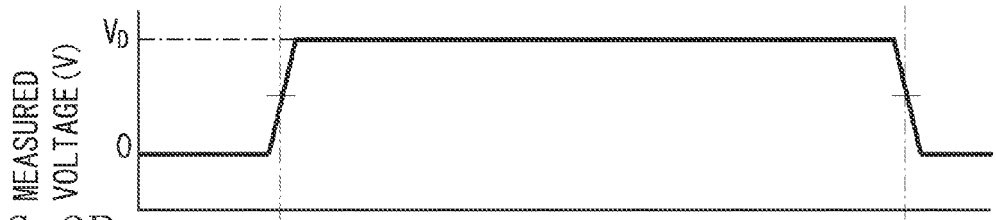
FIGS. 3A to 3D illustrate time relationship among measured voltages, drive signals, and current values.
Figure 3B:
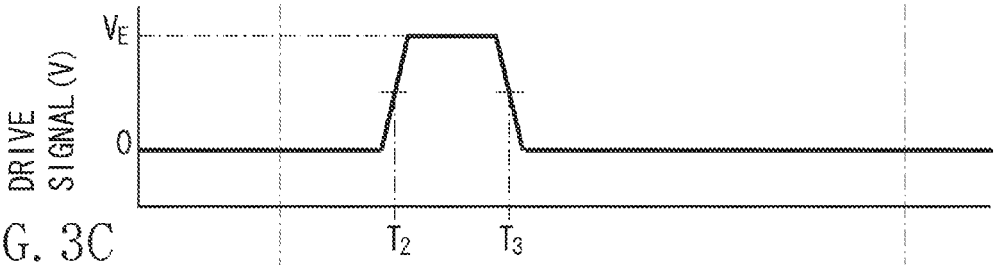
Figure 3C:
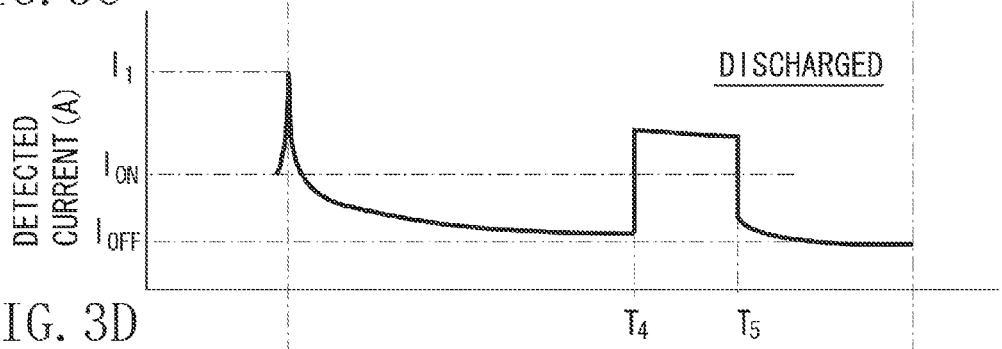
Figure 3D:
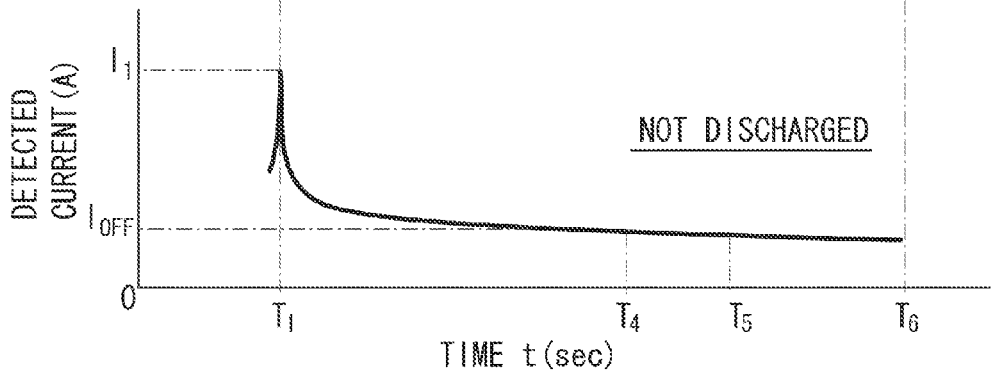

FIG. 3A illustrates the voltage applied between the protective layer 4 and the counter electrode 5 by the voltage applying unit 11. FIG. 3B illustrates a drive pulse to be input to the switching element to drive the heating unit 3. The heating unit 3 is energized at the timing the drive pulse is being input to the switching element, and the heating unit 3 is driven. FIGS. 3C and 3D illustrate current values measured by the measurement device 12.

Figure 2A:
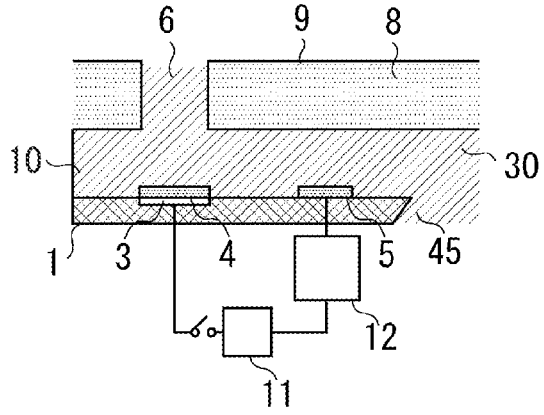
FIGS. 2A to 2D are schematic views illustrating changes in states of an inkjet recording head.

FIG. 2A illustrates a state of the inkjet recording head 9 at time t=0 in FIGS. 3A to 3D. In the state, as illustrated in FIGS. 3A and 3B, the voltage is not applied between the protective layer 4 and the counter electrode 5, and the drive pulse is not applied to the switching element to drive the heating unit 3.

Figure 2B:
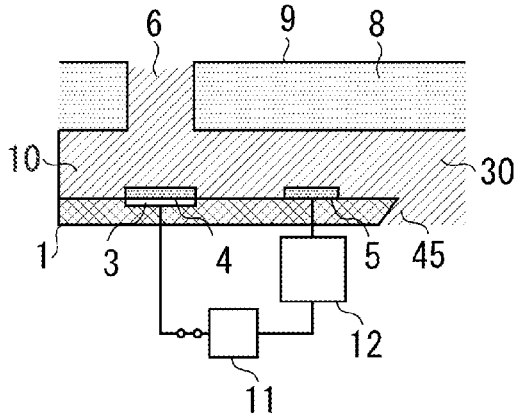

FIG. 2B illustrates a state of the inkjet recording head 9 at time $t=T_1$ in FIGS. 3A to 3D. As illustrated in FIG. 3A, if a voltage VD is applied between the protective layer 4 and the counter electrode 5 at the timing of the time $t=T_1$, as illustrated in FIG. 3C, an electric current flows between the protective layer 4 and the counter electrode 5 through the ink, then, a current value $I_1$ is measured. Then, the movement of the electric charge in the ink in the vicinity of the protective layer 4 and the counter electrode 5 slows down. Accordingly, measured current value gradually decreases, and converges around a value $T_{OFF}$.

Figure 2C:
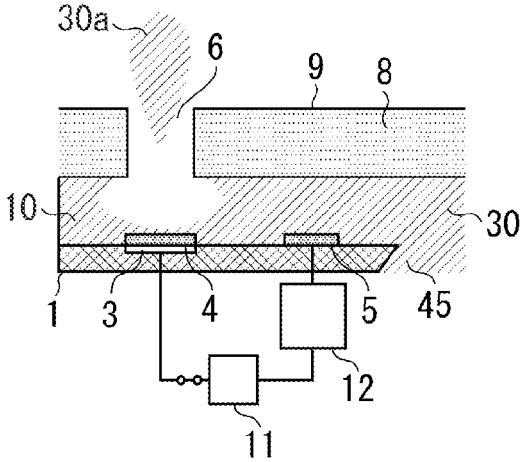

FIG. 2C illustrates a state of the inkjet recording head 9 at time $t=T_3$ in FIG. 3B. As illustrated in FIG. 3B, if the drive pulse for turning on the switching element is applied from the time $t=T_2$ to $T_3$, the heating unit 3 produces thermal energy for discharging the ink, and as illustrated in FIG. 2C, at the time $t=T_3$, an ink droplet 30*a* is discharged.

Figure 2D:
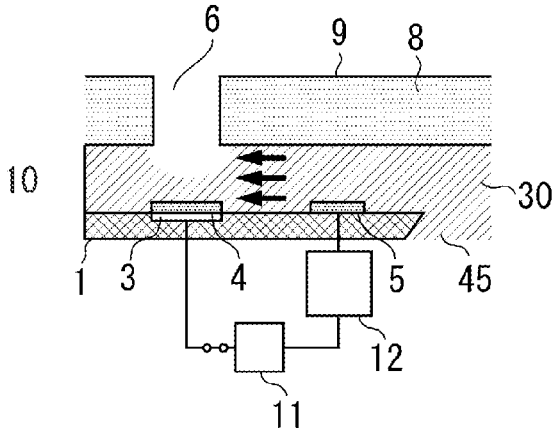

The ink in which the movement of the electric charge slows down is discharged as the ink droplets. Then, as illustrated in FIG. 2D, new ink is refilled from the supply port 45. Accordingly, the electric charge in the ink in the vicinity of the protective layer 4 and the counter electrode 5 can move. More specifically, as illustrated in FIG. 3C, while the new ink is being refilled (from time $t=T_4$ to $T_5$), the current values change.

On the other hand, if the heating unit 3 is energized by the drive pulse but the ink is not discharged as ink droplets, as illustrated in FIG. 3D, even in the time $t=T_4$ to $T_5$, the measured current value does not change, and at the time $t=T_2$, the current value becomes a substantially the same current value $I_{OFF}$.

Whether the ink is discharged or not can be determined by determining that the ink is discharged if the current value measured after the drive pulse is input becomes a predetermined threshold ($I_{ON}$) or more, and determining that the ink is not discharged if the current value does not exceed the threshold ION after the drive pulse is input.

(Burnt Deposit Removal Operation)

The cleaning operation for removing a burnt deposit adhered on the surface of the protective layer 4 due to long-term use of the inkjet recording head 9 is described. When a cleaning voltage for removing the burnt deposit (hereinafter, also referred to as a second voltage) is applied by the voltage applying unit 11 such that the protective layer 4 is to be an anode electrode and the counter electrode 5 is to be a cathode electrode, an electrochemical reaction occurs be between the protective layer 4 and the ink. Accordingly, the metal on the surface of the protective layer 4 dissolves, and the burnt deposit adhered on the surface of the protective layer 4 is removed.

Generally, whether the metal on the surface dissolves in a solution by an electrochemical reaction can be understood by seeing potential-pH diagrams of various metals. Iridium and ruthenium are materials having the property of dissolving by application of predetermined voltage as an anode electrode at a pH value of the ink.

Further, the material used for the protective layer 4 is required to have the property of not easily oxidizing and electrically stable even if voltage is applied for the burnt deposit removal operation and the determination of the ink discharge state, and the heat for the recording operation is applied. Iridium and ruthenium do not easily oxidize if they are heated to a temperature around 700° C., that is the heating temperature of the heating unit 3 for discharging the ink, and accordingly, iridium and ruthenium are suitable for the material of the protective layer 4 and the counter electrode 5.

The burnt deposit removal operation can be performed when the non-discharge state is detected using the protective layer 4. Further, after the burnt deposit is removed, the non-discharge state can be checked using the protective layer 4 again, thus whether the burnt deposit has been removed can be accurately checked.

(Cleaning Operation Sequence)

Figure 6:
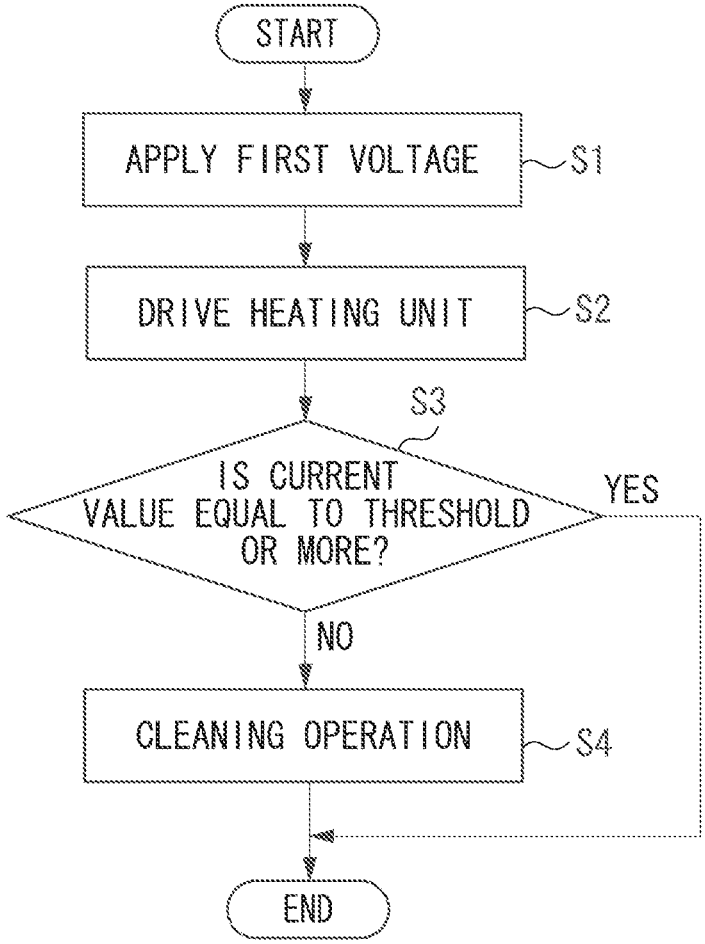
FIG. 6 is a flowchart illustrating a processing procedure of cleaning processing.

The procedure of the cleaning operation of the recording head using the discharge state determination and the burnt deposit removal operation is described. FIG. 6 is a flowchart illustrating the cleaning operation performed by the inkjet recording apparatus illustrated in FIG. 5. The cleaning operation can be performed as needed, for example, before the recording operation is started, or every time a plurality of sheets is printed.

In step S1, in response to the start of the cleaning operation, the first voltage for discharge detection is applied between the protective layer 4 and the counter electrode 5 using the voltage applying unit 11.

In step S2, the calculation unit 21 reads pulse width data for discharge detection from the EEPROM 25 in order to drive the heating unit 3 and drives the heating unit 3 by controlling the switching element using a drive pulse with such pulse width.

In the processing, a pulse width shorter than that used in performing the recording operation on the recording medium is used as the pulse width for discharge detection. More specifically, the non-discharge state is checked by supplying an amount of energy smaller than that actually used in the recording operation. Accordingly, an influence of the burnt deposit adhesion on the surface of the protective layer 4 can be detected at an early stage.

Further, in step S3, the calculation unit 21 acquires the current value measured by the measurement device 12. If the current value measured by the measurement device 12 is equal to the threshold ($I_{ON}$) or more (YES in step S3), the processing proceeds to the burnt deposit removal operation in step S4. If the current value measured by the measurement device 12 is less than the threshold ($I_{ON}$) (NO in step S3), the cleaning operation ends. In the processing, whether to perform the cleaning operation or not is determined based on the threshold (ION). However, whether to perform the cleaning operation or not can be determined using a change in the current value such as increase or decrease of the current value without setting the threshold ($I_{ON}$).

In step S4, in the burnt deposit removal operation, the second voltage for burnt deposit removal operation is applied between the protective layer 4 and the counter electrode 5 using the voltage applying unit 11 such that the protective layer 4 is to be the anode electrode. Accordingly, the metal on the surface of the protective layer 4 dissolves into the ink together with the burnt deposit, and the cleaning operation ends.

The second voltage for burnt deposit removal operation is higher than the first voltage for discharge detection. This is because, in the burnt deposit removal, the application of high voltage can efficiently produce the electrochemical reaction between the protective layer 4 and the ink in short time, and remove the burnt deposit. Further, in the discharge detection, if voltage higher than necessary is applied, the surface of the protective layer 4 dissolves more than necessary. Then, the life of the inkjet recording head 9 is unnecessarily shortened.

When the burnt deposit removal operation is performed, the dissolved material component of the protective layer 4 and the flaked burnt deposit remain in the ink in the flow path 10. If such ink does not affect the recording quality, the ink can be directly used for next recording operation. However, the ink can be discharged by performing a suction recovery operation, or the like.

In the present procedure, it is described that after the first voltage is applied between the protective layer 4 and the counter electrode 5, the heating unit 3 is driven immediately. However, the present invention is not limited to this example. For example, after the first voltage is applied, the heating unit 3 can be driven after waiting a certain period of time until the measured current value will be less than or equal to a predetermined threshold. Thus, the heating unit 3 can be driven in a state where the measured current value is surely stable. Accordingly, whether the current value in the discharge of the ink exceeds the threshold can be detected, and the discharge determination can be surely performed.

As described above, when the ink is not discharged even if the heating unit 3 is driven using the drive pulse for discharge detection operation, the electrochemical reaction between the protective layer 4 as the anode electrode and the ink is produced, and the metal of the surface of the protective layer 4 dissolves. As a result, the film thickness of the protective layer 4 becomes thinner as the cleaning operation is performed. Then, if the recording operation is performed by driving the heating unit 3 by always using the same drive pulse, energy more than necessary is transferred to the ink, and the discharge amount increases. As a result, the quality of the recorded image may be decreased.

Figure 7:
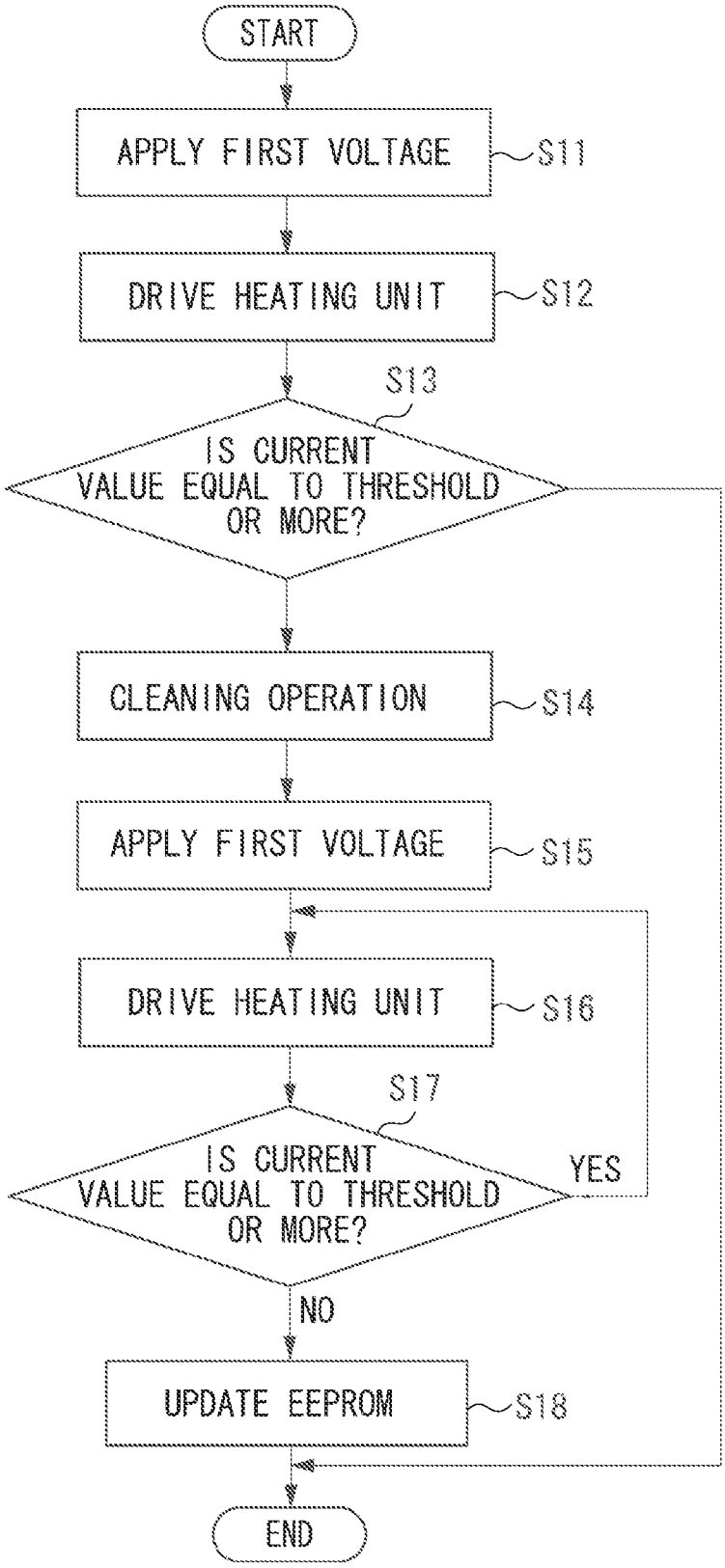
FIG. 7 is a flowchart illustrating a processing procedure of discharge energy change processing.

Further, the protective layer 4 and the insulating layer 106 are heated more than necessary, and then, the life of the inkjet recording head 9 may be decreased. To solve these issues, after the burnt deposit removal operation is performed, it is preferable to calculate an optimum discharge energy amount for discharging the ink. FIG. 7 illustrates a flowchart of the cleaning operation including such discharge energy determination processing.

The processing in steps S11 to S14 is similar to that in steps S1 to S4 illustrated in FIG. 6.

Next, an optimum energy amount in the recording operation is determined. The optimum energy amount can be changed by changing the drive conditions of the heating unit 3. In the present exemplary embodiment, an example of changing the pulse width of the drive pulse is described. As the protective layer 4 becomes thinner, the energy amount necessary for the discharge decreases. Then, it is assumed that the optimum pulse width becomes narrower than that before the burnt deposit removal operation is performed.

In step S15, the first voltage for discharge detection is applied between the protective layer 4 and the counter electrode 5 by the voltage applying unit 11.

In step S16, the heating unit 3 is driven with using a drive signal of a pulse width one step narrower than a minimum pulse width (Pth) required to discharge the ink from the discharge ports in the recording head before the cleaning operation. The minimum pulse width is stored in the EEPROM in advance.

In step S17, the calculation unit 21 acquires the current value measured by the measurement device 12. If the current value measured by the measurement device 12 is equal to the threshold ($I_{ON}$) or more (YES in step S17), then in step S16, the heating unit is driven with using a pulse width further narrower by one step. The operation is repeated until the current value becomes a value less than the threshold ($I_{ON}$).

If the current value becomes a value less than the threshold ($I_{ON}$) (NO in step S17), then in step S18, the minimum pulse width (Pth) required to discharge the ink on the EEPROM is newly updated with a pulse width one step wider than that of the drive pulse used to drive the heating unit at the time. A pulse width obtained by adding a certain amount of margin to the minimum pulse width (Pth) is actually used for the recording operation.

As described above, according to the present procedure, the cleaning operation including the burnt deposit removal processing and the discharge energy change processing can be performed as a series of processing with the recording processing.

Results of verification performed using the inkjet recording apparatus illustrated in FIG. 5 are described below.

The protective layer 4 and the counter electrode 5 of the inkjet recording head 9 used in the experiment were made of iridium with a thickness of about 100 nm respectively, and between the insulating layer 106 and the protective layer 4, an adhesion layer of tantalum with a thickness of about 100 nm is provided. For the ink, a magenta ink containing a dye sold under the name PGI-2M (made by Canon Inc.) was used.

The experimental method is illustrated in FIG. 6. First, the heating unit 3 is driven using the pulse width for the recording operation for a certain period of time such that a burnt deposit adheres on the surface of the protective layer 4. Then, the heating unit 3 is driven using the pulse width for discharge detection while the first voltage for discharge detection is applied between the protective layer 4 and the counter electrode 5. Further, whether the current value flowing between the protective layer 4 and the counter electrode 5 exceeds the threshold is determined. When the current value exceeds the threshold, the burnt deposit removal operation is performed.

As a result of measurement of the minimum pulse width of the drive signal required to discharge the ink in a state the burnt deposit is not adhered on the surface of the protective layer 4, the required minimum pulse width was 1.3 μsec at the drive voltage of 20 V of the heating unit 3. The drive pulse width is set as the drive pulse width for discharge detection.

Further, in consideration of variation, 1.5 μsec that is obtained by multiplying 1.3 μsec by a coefficient 1.15 was used as the drive pulse width to be used in the recording operation. Using the drive signal with the drive pulse width, the heating unit 3 was driven by pulses of $5.0*10^6$ at the voltage of 20 V and the frequency of 5 kHz. In the processing, when the surface of the protective layer 4 was observed, adhesion of the burnt deposit on the surface of the protective layer 4 was not found. Further, decrease in the image quality was not found when the recording operation was performed.

Then, direct current (DC) voltage of 2.5 V was applied between the protective layer 4 and the counter electrode 5 using the voltage applying unit 11, and the heating unit 3 was driven using the drive pulse for discharge detection of the drive pulse width of 1.3 μsec. At this time, discharge of the ink was confirmed, and increase of the electric current measured by the measurement device 12 was found.

Next, using the drive pulse width of 1.5 μsec, the heating unit 3 was driven by pulses of $5.0*10^7$ at the voltage of 20 V and the frequency of 5 kHz. At this time, when the surface of the protective layer 4 was observed, substantially uniform adhesion of burnt deposits on the surface of the protective layer 4 was found. At the same time, when the recording operation was performed, unevenness in the image was found.

Then, DC voltage of 2.5 V was applied between the protective layer 4 and the counter electrode 5 using the voltage applying unit 11, and the heating unit 3 was driven using the drive pulse for discharge detection of the drive pulse width of 1.3 μsec. At this time, discharge of the ink was not found, and no change in the electric current measured by the measurement device 12 was found.

Then, DC voltage of 10 V was applied between the protective layer 4 and the counter electrode 5 using the voltage applying unit 11 for 30 seconds such that the protective layer 4 was to be the anode electrode and the counter electrode 5 was to be the cathode electrode. As a result, it was found that the burnt deposit adhered on the surface of the protective layer 4 was removed.

From the results of the above-described experiment, it is understood that the discharge state of the ink can be checked by monitoring the current values flowing between the protective layer 4 and the counter electrode 5 through the ink measured by the measurement device 12, and the timing for performing the cleaning operation can be determined.

Next, in order to check whether a difference in the thermal energy necessary to discharge the ink is produced or not, a comparison was performed between the recording head which performed a series of the processing for performing the cleaning operation after the heating unit 3 was driven by $5.0*10^7$ pulses (drive pulse width is 1.3 μsec) five times with the recording head which performed the series of the processing ten times.

The heating units 3 of the both of the recording heads were driven by the drive signal with the drive pulse width of 1.3 μsec. Then, in the both of the recording heads, discharge of the ink was confirmed, and increases of the current values measured by the measurement device 12 were also found.

Next, to the both of the inkjet recording heads, the drive signal with the drive pulse width of 1.2 μsec was applied to drive the heating units 3.

At the time, in the recording head which performed the cleaning operation five times, the ink was not discharged, and no change was found in the measured current value. In other words, it was found that there was no change in the thermal energy necessary to discharge the ink.

On the other hand, in the recording head which performed the cleaning operation ten times, discharge of the ink was found, and change in the measured current values was found. In other words, it was found that the film thickness of the protective layer 4 became thinner by the cleaning operation of ten times, and the thermal energy necessary to discharge the ink decreased. From the results of the above-described experiment, it is understood that if the film thickness of the protective layer 4 became thinner by the cleaning operation, the energy amount necessary for discharge changed.

Accordingly, the recording head according to the present exemplary embodiment of the present invention can perform the burnt deposit removal operation and the discharge detection operation using the protective layer 4 and the counter electrode 5. By appropriately performing the burnt deposit removal operation, the decrease in the ink discharge speed can be prevented, and the decrease in the thermal conductivity from the heating unit 3 to the ink can be reduced. As a result, the highly reliable recording operation can be performed without increasing the thermal energy for discharging ink. Further, by resetting the energy amount necessary for the recording operation after the cleaning operation, the life of the recording head can be increased.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-151945 filed Jul. 2, 2010, which is hereby incorporated by reference herein in its entirety.

What is claimed is:

1. An inkjet recording apparatus comprising:

an inkjet recording head including a heating unit configured to produce thermal energy for discharging ink, and a pair of electrodes which are disposed facing a flow path of the ink and electrically connect with each other through the ink;

a voltage applying unit configured to apply voltage between the pair of electrodes;

a measurement unit configured to measure a current value flowing between the pair of electrodes; and a control unit configured to drive the heating unit in a state that the voltage is applied by the voltage applying unit, and determine whether the current value to be measured by the measurement unit exceeds a predetermined threshold.

2. The inkjet recording apparatus according to claim 1, wherein one of the pair of electrodes contains a metallic material that dissolves by an electrochemical reaction with the ink, and is disposed in an area heated by the heating unit.

3. The inkjet recording apparatus according to claim 1, wherein at least one of the pair of electrodes is made of a material containing iridium or ruthenium.

4. A method for controlling an inkjet recording apparatus that includes an inkjet recording head including a heating unit configured to produce thermal energy for discharging ink, and a pair of electrodes which are disposed facing a flow path of the ink and electrically connect with each other through the ink, the method comprising:

measuring a current value flowing through the ink by applying voltage between the pair of electrodes; and determining whether the current value exceeds a predetermined threshold when the heating unit is driven.

5. The method according to claim 4, wherein one of the pair of electrodes of the inkjet recording head contains a metallic material that dissolves by an electrochemical reaction with the ink, and is disposed in an area heated by the heating unit, and further comprising, if it is determined that the current value does not exceed the predetermined threshold, performing cleaning processing by applying voltage such that the one of the electrodes is to be an anode electrode.

6. The method according to claim 5, wherein the voltage applied in the cleaning processing is greater than the voltage applied in the measurement processing.

7. The method according to claim 4, wherein at least one of the pair of electrodes is made of a material containing iridium or ruthenium.

* * * * *